United States Patent [19]

Nava

[11] Patent Number: 4,464,799

[45] Date of Patent: Aug. 14, 1984

[54] DEVICE TO SECURE A THROATBAND ON HELMETS AND SIMILAR HEADGEAR

[76] Inventor: Pier L. Nava, Verderio Superiore (Como), Italy

[21] Appl. No.: 280,964

[22] Filed: Jul. 7, 1981

[30] Foreign Application Priority Data

Jul. 16, 1980 [IT] Italy ..... 22317/80[U]

[51] Int. Cl.[3] ..... A42B 3/02

[52] U.S. Cl. ..... 2/421; 24/265 H

[58] Field of Search ..... 2/421, 10, 424; 24/230 TC, 265 R, 265 A, 265 EC, 265 H

[56] References Cited

U.S. PATENT DOCUMENTS 3,323,184 6/1967 Reiter ..... 24/265 A X
3,990,113 11/1976 Coenen ..... 2/421

FOREIGN PATENT DOCUMENTS 0052068 5/1982 European Pat. Off. ..... 2/421
2812069 10/1979 Fed. Rep. of Germany ..... 2/421
1237727 6/1971 United Kingdom ..... 24/230 TC

*Primary Examiner*—Peter P. Nerbun
*Attorney, Agent, or Firm*—Ladas & Parry

[57] ABSTRACT

The device (FIG. 2) comprises a plaque (14), which presents at its ends, on the one side, a hook (18) and, on the other side, an aperture (12) in which is placed the throatband (C).

The end, shaped as a hook (18), of the plaque is engaged with a cross piece (22), which comprises two parallel apertures (25) provided in a ledge ($A_1$) of the wall of the helmet (A). The plaque (14), in proximity of the hook (18), presents a hole (20) in which is engaged an appendix (30) of a cover (26), which closes the ledge ($A_1$) of the wall of the helmet.

8 Claims, 3 Drawing Figures

DEVICE TO SECURE A THROATBAND ON HELMETS AND SIMILAR HEADGEAR

DESCRIPTION

This invention relates to a device apt to secure the throatband on helmets and similar headgears.

Protective helmets, such as those used in sports must necessarily be suitable to ensure a firm fit of the helmet on the user's head and on the other hand, the ends of the band forming the throatband must be firmly secured to the walls of the helmet to withstand the usual stresses.

On the usual helmets, the securing of the throatband to the helmet wall is complex and requires special attention in order to secure anchorage of the throatband to the inside of said helmet.

The invention proposes to substantially simplify the operations necessary to secure the throatband to the helmet walls, and to provide a firm anchorage of the connection.

Moreover, the invention affords the possibility of simple and quick replacement of the throatband by the user without in any way altering or removing the internal padding of the helmet.

The device according to the invention is characterized by a plaque, one of the ends of which holds the band and the other end is shaped as a hook to engage movably a cross piece in the wall of the helmet, said latter end being provided with connecting and locking means to hold, elastically forcible, a cover for said cross piece and to ensure engagement of the latter with the hook.

The hook of the anchoring plaque is provided, advantageously, in a suitable position, with at least one aperture in which engages a relevant appendix, secured to the rear face of the cover for the cross piece, delimited by two slots in the wall of the helmet in a manner such that the appendix will engage, in addition to the opening in the plaque, also the cross piece, thus ensuring reciprocal securing of said parts to the helmet.

The invention will now be described in conjunction with the annexed drawing which illustrates, by way of example, one preferred form of embodiment of the device.

Figure 1:
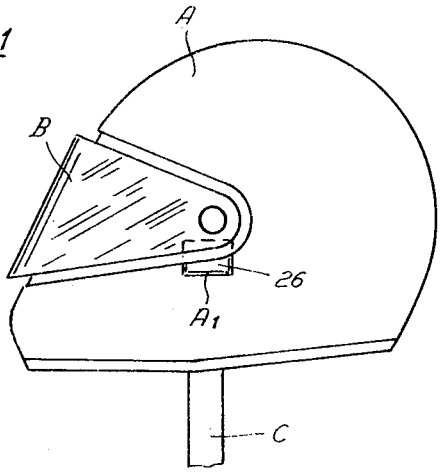
FIG. 1 is a side view of the helmet, fitted with the device.
Figure 3:
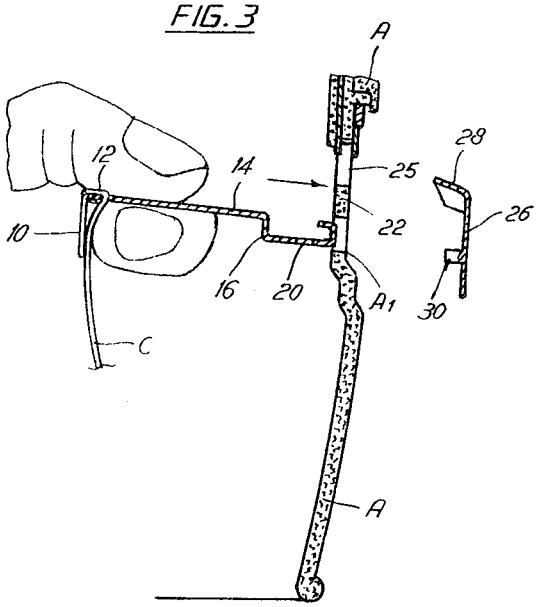

FIG. 3, like FIG. 1, shows the initial position of the device, with respect to the helmet.

In the figures of the drawing A identifies the helmet fitted with visor B and throatband C consisting, in the known manner, of a band of suitable material. According to the invention, one or both the ends 10 of band C are secured in the known manner to one of the ends 12 of a plaque 14 of suitable material, even molded plastic material. The other end of the plaque, is provided, in succession, with a first right angle bend 16 forming a projection while the two other bends 18 form a hook Plaque 14 is provided with a hole 20 in a position close the hook 18, arranged so as to coincide with the bottom edge of a cross piece 22 on the bottom of a ledge $A_1$ in the side wall of helmet A. In the case illustrated, the cross piece is obtained by cutting two horizontal slots 24 and 25 of suitable dimensions in bottom $A_1$.

Figure 2:
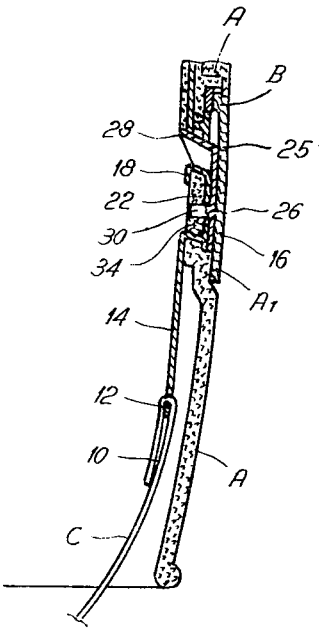
FIG. 2 is a vertical cross section, on a larger scale, of the part in FIG. 1 which holds the device.

As shown in FIG. 3, hook 18 is inserted and successively engaged in slots 24 and 25, so that when said hook engages cross piece 20, projection 16 in plaque 14 engages with the bottom edge of slot 25 as shown in FIG. 2,thereby providing a double anchorage of band C to helmet A.

Ledge $A_1$ in helmet A is closed by a cover 26 suitably shaped to fit on the edges of the ledge, while the top part of the cover is provided with an inclined wing 28 which engages the top part (edge) of slot 25. The rear face of cover 26 is provided, around its center part, with a pin shaped appendix 30 which engages in hole 20 of plate 14 in a position close to hook 18.

It is evident from what above stated that hook 18 in plaque 14 is held to helmet A by cross piece 20 and locked in place by pin 30 in cover 26. The latter is in turn firmly held to helmet A (within the opening in ledge $A_1$) both by the resiliant fitting (formed by pin 30 and wing 28) and by the end of visor B which covers at least part of the aperture in said ledge $A_1$. Moreover, due to the orientation of wing 28 and because of its flexibility, cover 26 is kept adherent to hook 28 and this in turn to cross piece 22 in the bottom of ledge $A_1$ of helmet A. On the other hand it is always possible for the user to remove hook 18 with band C simply and quickly, for replacing or cleaning the band.

The complete and simple achievement of the object of the invention is thus confirmed, especially as the device according to the invention can be fabricated conveniently also of molded plastic material depending on the characteristics of the helmet to which the device will be applied.

I claim:

1. Device for securing a throatband of a helmet comprising:

(a) the helmet having at least one upper opening and one lower opening situated within a wall of said helmet, said upper and lower openings are divided by a portion of said wall;

(b) a plaque having a first end attached to the throatband and a second end designed for an engagement with said upper and lower openings, said second end having an angle bend portion and a hook shaped portion, said angle bend and hook shaped portions are connected to each other by a connecting portion, said angle bend portion engaging said lower opening, said hook shaped portion engaging said upper opening and said connecting portion engaging said portion dividing said openings;

(c) a cover portion interposed between said second end of the plaque and visor means of the helmet, said cover portion resiliently fitted within the wall of the helmet and said upper opening thereof;

whereby in a working condition of the device said visor means presses said cover portion to said second end of the plaque to ensure a safe engagement of said second end to the wall of the helmet.

2. Device according to claim 1, characterized in that the hook forms part of an anchoring device that is provided in suitable position with at least one aperture (20) to engage the relevant appendix (30) in the rear face of a cover portion which covers said portion of said wall of the helmet, delimited by lower and upper slots (24, 25) in the walls of the helmet so that said appendix (30) may engage, in addition to the aperture in plaque (14), also said portion of said wall, to ensure reciprocal locking of the parts to the helmet.

3. Device according to claims 1 or 2, characterized in that said portion of said wall is presented in the bottom of a ledge ($A_1$) in the side wall of the helmet, whose aperture is closed by the cover portion (26).

4. Device according to claim 2 characterized in that plaque (14), is provided, in a position close to its locked end (18) with a right angle fold (16) engaging with the edge of lower slot (24) which partly delimits said portion of said wall.

5. Device according to claim 2 or 4, characterized in that it is provided with a wing (28) formed by at least a part of the edge of the cover portion (26) and which elastically forcible engages the top edge of upper slot (25) in the wall of the helmet.

6. Device according to claim 5 characterized in that wing (28) in the cover portion (26) is inclined and acts in contrast with the appendix (30) of said cover (26) to press the latter elastically against the bottom of the ledge ($A_1$) which houses the cover.

7. Device according to claim 1, characterized in that at least a part of the visor (B) of the helmet engages with said cover portion (26).

8. Protective helmet according to claim 2 characterized in that its throatband (C) is movably secured to the helmet walls by at least the anchoring device.

* * * * *